US006484426B1

(12) United States Patent
Hales

(10) Patent No.: US 6,484,426 B1
(45) Date of Patent: Nov. 26, 2002

(54) GIFT DISPLAYING SYSTEM

(76) Inventor: Allan J. Hales, 71 Leighton Road, Bush Hill Park, Enfield EN1 1XN (GB)

( * ) Notice: Subject to any disclaimer, the term of this patent is extended or adjusted under 35 U.S.C. 154(b) by 97 days.

(21) Appl. No.: 09/770,372

(22) Filed: Jan. 26, 2001

(51) Int. Cl.[7] ..... G09F 19/12
(52) U.S. Cl. ..... 40/427; 427/51
(58) Field of Search ..... 40/406, 427; 472/51, 472/52, 53, 56; 102/361

(56) References Cited

U.S. PATENT DOCUMENTS

| | | | | |
|---|---|---|---|---|
| 1,340,863 A | | 5/1920 | Knight | |
| 2,704,903 A | | 3/1955 | Laughlin | |
| 4,005,657 A | * | 2/1977 | Rothman | |
| 4,059,917 A | * | 11/1977 | Sims et al. | |
| 4,782,950 A | | 11/1988 | Santoro | |
| D315,001 S | | 2/1991 | Bennet | |
| 5,109,773 A | * | 5/1992 | Kaneko | 102/361 X |
| 5,304,096 A | * | 4/1994 | Wilk | 40/427 X |
| 5,343,808 A | | 9/1994 | Collar | |
| 5,435,787 A | * | 7/1995 | Ratcliffe | 472/56 |
| 5,901,496 A | | 5/1999 | Wickers | |

* cited by examiner

*Primary Examiner*—Joanne Silbermann

(57) ABSTRACT

A gift displaying system for resembling a snowman for displaying a plurality of gifts tied together. The gift displaying system includes a cover resembling a figurine for concealing any gifts, said cover member comprising a head member, said head member comprising a generally cotton material having a generally spherical-shape, and a body member comprising a panel being attached to and extending downwardly from a lower portion of said head member such that said panel defines a cavity extending from a free edge of said panel toward said head member, said body member comprising a generally cotton material. The invention further comprises a gift connecting assembly for connecting the gifts together that includes a plurality of connecting members. Each of the connecting members may be. releasably tied around at least two of the gifts. The gift connecting assembly further comprises a plurality of crackers. Each of the crackers is coupled to one of said connecting members and may be positioned generally between a pair of the gifts.

15 Claims, 4 Drawing Sheets

GIFT DISPLAYING SYSTEM

BACKGROUND OF THE INVENTION

1. Field of the Invention

The present invention relates to decorative package enclosures and more particularly pertains to a new gift displaying system for resembling a snowman for displaying a plurality of gifts tied together.

2. Description of the Prior Art

The use of decorative package enclosures is known in the prior art. More specifically, decorative package enclosures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,704,903; 4,782,950; 5,343,808; 5,901,496; 1,340,863; and U.S. Pat. No. Des. 315,001.

While these devices fulfill their respective, particular objectives and requirements, the aforementioned patents do not disclose a new gift displaying system. The inventive device includes a cover resembling a figurine for concealing any gifts, said cover member comprising a head member, said head member comprising a generally cotton material having a generally spherical-shape, and a body member comprising a panel being attached to and extending downwardly from a lower portion of said head member such that said panel defines a cavity extending from a free edge of said panel toward said head member, said body member comprising a generally cotton material. The invention further comprises a gift connecting assembly for connecting the gifts together that includes a plurality of connecting members. Each of the connecting members may be releasably tied around at least two of the gifts. The gift connecting assembly further comprises a plurality of crackers. Each of the crackers is coupled to one of said tying members and may positioned generally between a pair of the gifts.

In these respects, the gift displaying system according to the present invention substantially departs from the conventional concepts and designs of the prior art, and in so doing provides an apparatus primarily developed for the purpose of resembling a snowman for displaying a plurality of gifts tied together.

SUMMARY OF THE INVENTION

In view of the foregoing disadvantages inherent in the known types of decorative package enclosures now present in the prior art, the present invention provides a new gift displaying system construction wherein the same can be utilized for resembling a snowman for displaying a plurality of gifts tied together.

The general purpose of the present invention, which will be described subsequently in greater detail, is to provide a new gift displaying system apparatus and method which has many of the advantages of the decorative package enclosures mentioned heretofore and many novel features that result in a new gift displaying system which is not anticipated, rendered obvious, suggested, or even implied by any of the prior art decorative package enclosures, either alone or in any combination thereof.

To attain this, the present invention generally comprises a cover resembling a figurine for concealing any gifts, said cover member comprising a head member, said head member comprising a generally cotton material having a generally spherical-shape, and a body member comprising a panel being attached to and extending downwardly from a lower portion of said head member such that said panel defines a cavity extending from a free edge of said panel toward said head member, said body member comprising a generally cotton material. The invention further comprises a gift connecting assembly for connecting the gifts together that includes a plurality of connecting members. Each of the connecting members may be releasably tied around at least two of the gifts. The gift connecting assembly further comprises a plurality of crackers. Each of the crackers is coupled to one of said tying members and may positioned generally between a pair of the gifts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gift displaying system apparatus which has many of the advantages of the decorative package enclosures mentioned heretofore and many novel features that result in a new gift displaying system which is not anticipated, rendered obvious, suggested, or even implied by any of the prior art decorative package enclosures, either alone or in any combination thereof.

It is another object of the present invention to provide a new gift displaying system which may be easily and efficiently manufactured and marketed.

It is a further object of the present invention to provide a new gift displaying system which is of a durable and reliable construction.

An even further object of the present invention is to provide a new gift displaying system which is susceptible of a low cost of manufacture with regard to both materials and labor, and which accordingly is then susceptible of low prices of sale to the consuming public, thereby making such gift displaying system economically available to the buying public.

Still yet another object of the present invention is to provide a new gift displaying system which provides in the apparatuses of the prior art some of the advantages thereof, while simultaneously overcoming some of the disadvantages normally associated therewith.

Still another object of the present invention is to provide a new gift displaying system for resembling a snowman for displaying a plurality of gifts tied together.

Yet another object of the present invention is to provide a new gift displaying system which includes a cover resembling a figurine for concealing any gifts, said cover member comprising a head member, said head member comprising a generally cotton material having a generally spherical-shape, and a body member comprising a panel being attached to and extending downwardly from a lower portion of said head member such that said panel defines a cavity extending from a free edge of said panel toward said head member, said body member comprising a generally cotton material. The invention further comprises a gift connecting assembly for connecting the gifts together that includes a plurality of connecting members. Each of the connecting members may be releasably tied around at least two of the gifts. The gift connecting assembly further comprises a plurality of crackers. Each of the crackers is coupled to one of said tying members and may positioned generally between a pair of the gifts.

Still yet another object of the present invention is to provide a new gift displaying system that increases the entertainment value of selecting a gift from a pile of gifts.

Even still another object of the present invention is to provide a new gift displaying system that provides an alternative means for storing and sorting wrapped packages such as gifts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
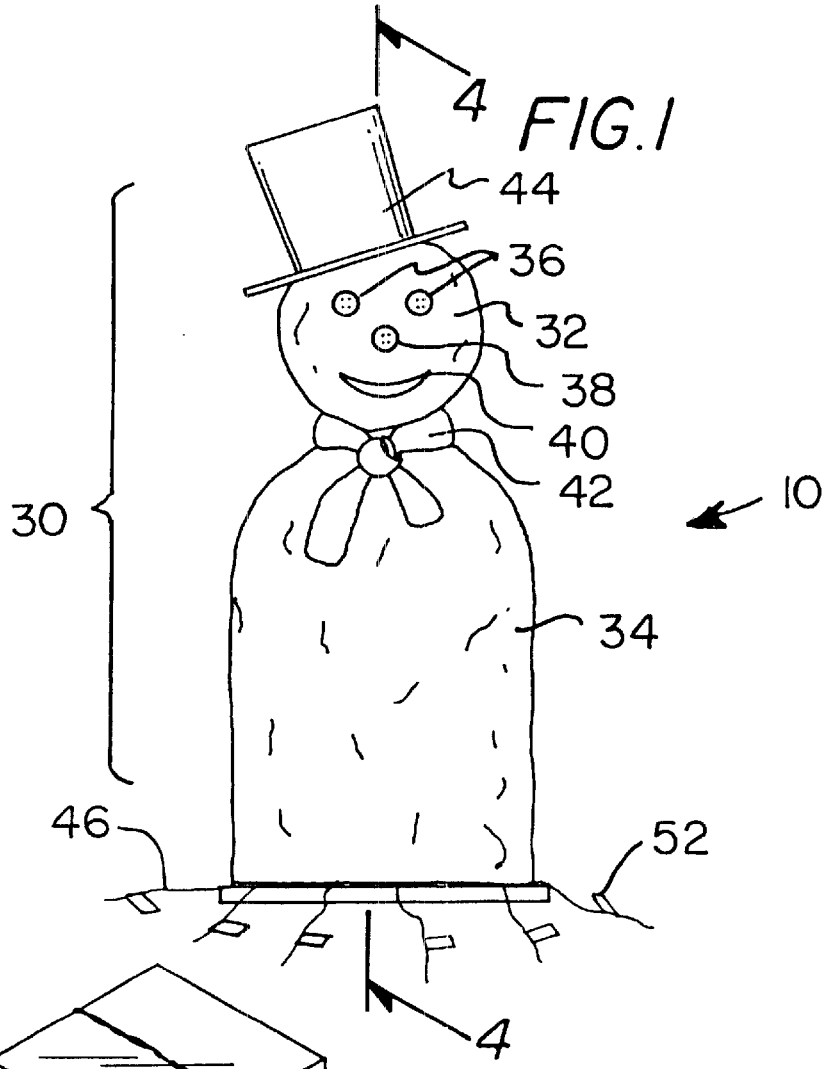
FIG. 1 is a schematic front view of a new gift displaying system according to the present invention.
Figure 3:
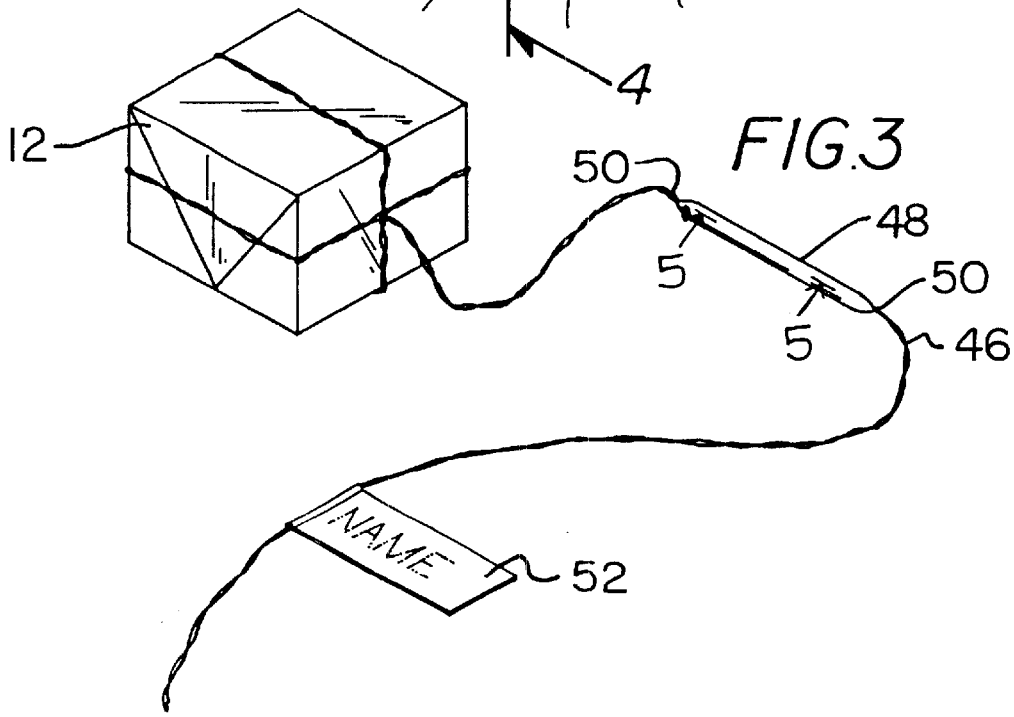
FIG. 3 is a schematic perspective view of the connecting members of the present invention.
Figure 2:
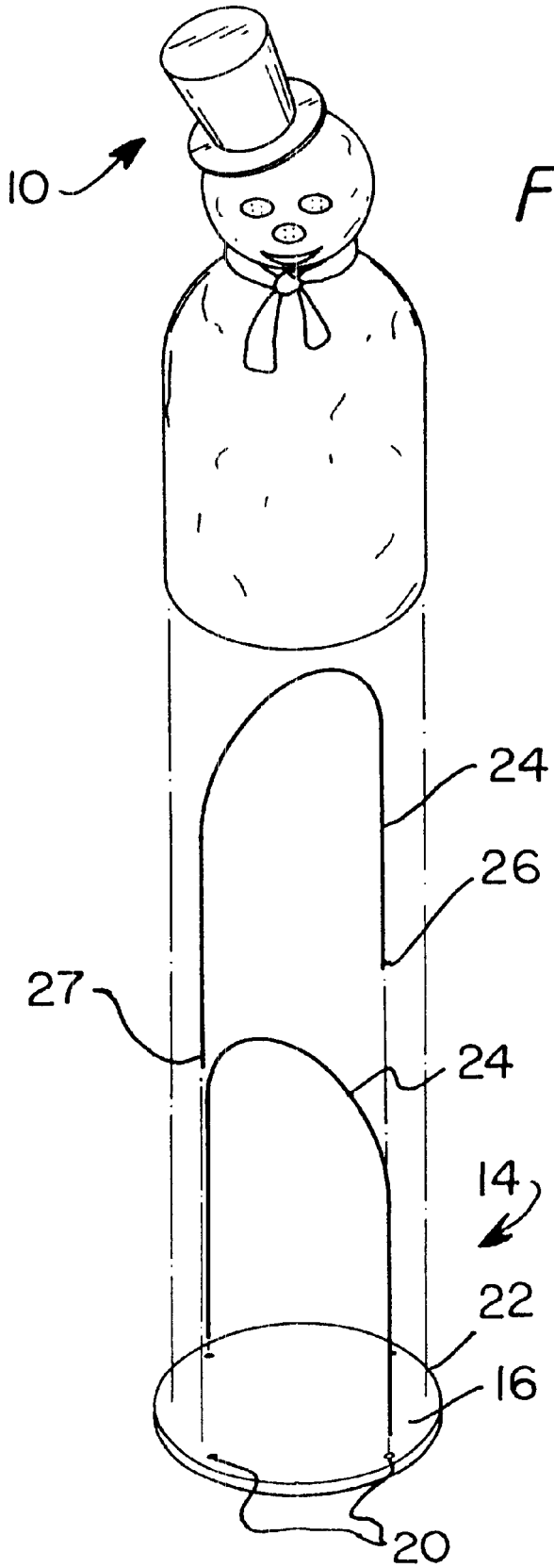
FIG. 2 is a schematic exploded view of the present invention.
Figure 4:
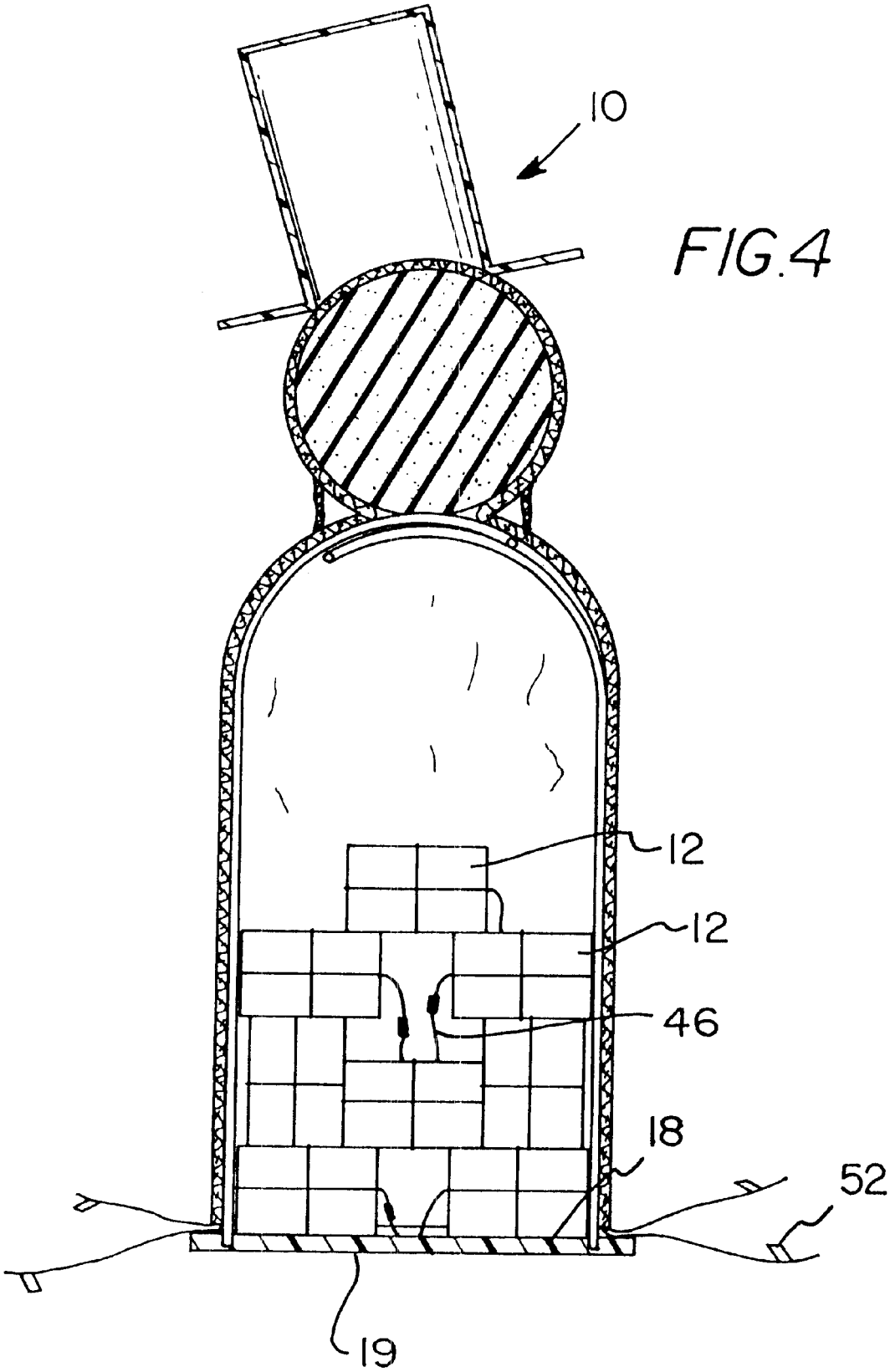
FIG. 4 is a schematic side sectional view of the present invention taken along line 4—4 of FIG. 1.
Figure 5:
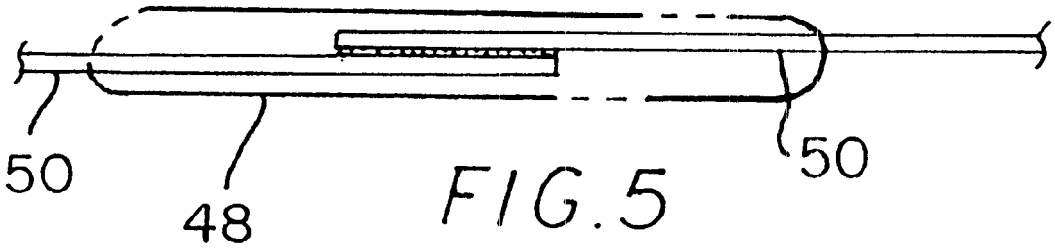
FIG. 5 is a schematic cross-sectional view of the present invention taken along line 5—5 of FIG. 3.

With reference now to the drawings, and in particular to FIGS. 1 through 5 thereof, a new gift displaying system embodying the principles and concepts of the present invention and generally designated by the reference numeral 10 will be described.

As best illustrated in FIGS. 1 through 5, the gift displaying system 10 generally resembles a snowman for displaying a plurality of gifts 12 tied together and generally comprises a frame 14 that includes a base 16 having a top surface 18, a bottom surface 19 and a peripheral edge 22. The top surface 18 has a plurality of holes 20 extending therein. Each of the holes 20 may be positioned generally adjacent to the peripheral edge 22 and each of the holes 20 is spaced apart around the peripheral edge 22 of the base 16. Preferably, the base 16 comprises a substantially rigid material.

The invention further comprises a plurality of arched members 24. Each of the arched members 24 has a pair of ends 26, 27 and each of the ends is removably insertable in one of the holes 20 in the base 16. The holes 20 are positioned in a manner such that a plane defined by a first arched member is orientated generally perpendicular to a plane defined by a second arched member. Preferably, each of the arched members 24 comprises a generally rigid material. In an embodiment of the invention, the gifts 12 are removably stored between each of the arched members 24 and selectively rest on the top surface 18 of the base 16.

The invention further comprises a cover member 30. Preferably, the cover member 30 resembles a snowman for concealing any gifts 12 resting on the base 16 of the frame 14. The cover member 30 includes a head member 32. The head member 32 may comprise a generally cotton material and have a generally spherical shape.

The cover member 30 further comprises a body member 34. The body member 34 includes a panel attached to and extending downwardly from a lower portion of the head member 32 such that the panel defines a cavity extending from a free edge 22 of the panel toward the head member 32. Preferably, the body member 34 comprises a generally cotton material.

In an embodiment of the invention, each of the arched members 24 are removably insertable into the cavity of the body member 34. Further, a plurality of ornamental members is securably attached to the head member 32. The plurality of ornamental members may comprise a pair of eye members 36 attached to a front portion of the head member 32. Preferably, each of the eye members 36 comprise a pair of generally circular disks. Each of the disks may comprise a substantially rigid material.

The plurality of ornamental members may further comprise a nose member 38 that is attached to the front portion of the head member 32 and positioned generally adjacent to the eye members 36. Preferably, the nose member 38 comprises a generally circular disk. Ideally, the disk comprises a substantially rigid material.

The plurality of ornamental members may further comprise a mouth member 40. The mouth member 40 is ideally attached to the front portion of the head member 32 and positioned generally adjacent to the nose member 38. Preferably, the mouth member 40 comprises a panel. The panel may comprise a generally cloth material.

In an embodiment of the invention, the plurality of ornamental members may further comprise a scarf 42. The scarf 42 generally has a pair of ends 26, 27 releasably tied together and is positioned Generally between the head member 32 and the body member 34. Ideally, the scarf 42 member comprises a cloth material.

The plurality of ornamental members may additionally comprise a hat 44 securably attached to a top portion of the head member 32. Preferably, the hat 44 comprises a top hat 44 having a crown coupled to a brim, such that the brim is attached to the head member 32. Ideally, the hat 44 comprises a generally rigid material.

The invention may further comprise a means for connecting the gifts 12 together. Ideally, the means for connecting the gifts 12 together comprises a plurality of connecting members 46. Each of the connecting members 46 may have a pair of ends 26, 27 and each of the members may be releasably tied around two of the gifts 12 such that a length of the connecting member 46 extends between the two gifts 12. One of the ends of each of the connecting members 46 may extend away from each of the tied gifts 12. Preferably, each of the connecting members 46 comprises a string.

The means for connecting the gifts 12 together may further comprise at least two crackers 48. Each of the crackers 48 may be coupled to one of the tying members and positioned generally between a pair of the gifts 12. Preferably, each of the crackers 48 comprises a pair of pull strips 50 having a first end and a second end.

In an embodiment of the invention, each of the first ends of each of the pull strips 50 is movably coupled together such that each first end of each of the pull strips 50 overlap each other. Preferably, each of the pull strips 50 comprises a resiliently flexible material.

The cracker may further comprise a casing for covering the first ends each of the pull strips 50. The casing may comprise a panel extending around the first end of each of the pull straps. Ideally, the casing comprises a generally paper material.

The crackers 48 may further comprise an explosive powder positioned between an inner surface of the overlapping pull strips 50. Ideally, the explosive powder comprises a substantially ignitable material. The invention may further comprise an ignition means for igniting the explosive powder. Preferably, the ignition means is attached to each of the pull strips 50 and positioned generally adjacent to the first end of each of the strips. Ideally, the ignition means comprises a flint.

In an embodiment of the invention, the second ends of each of the pull strips 50 of the cracker are pulled away from each other by pulling the gifts 12 apart. Thus, this action may cause the ignition means on the pull strips 50 to selectively engage causing a spark to ignite the explosive powder tearing the casing and creating a cracking noise.

The invention may further comprise a plurality of name tags 52. Preferably, each of the name tags 52 is attached to one of the ends of each of the connecting members 46. Ideally, each of the name tags 52 is positioned generally adjacent to one of the gifts 12 and extending underneath the free edge 22 of the body member 34. In an embodiment of the invention, each of the name tags 52 comprises a piece of substrate having a mark thereon.

In use, the packages may be tied with the connecting members and then placed with the name tags extending from beneath the cover member. A user pulls the connecting member thus activating the cracker for a popping sound before retrieving her package.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gift displaying system resembling a figurine for displaying a plurality of gifts tied together, said system comprising:

a cover resembling a figurine for concealing any gifts, said cover member comprising:

a head member, said head member comprising a generally cotton material having a generally spheroidal-shape;

a body member comprising a panel being attached to and extending downwardly from a lower portion of said head member such that said panel defines a cavity extending from a free edge of said panel toward said head member, said body member comprising a generally cotton material;

a means for connecting the gifts together, said means for connecting the gifts together comprising:

a plurality of connecting members, each of said connecting members being releasably tied around two of the gifts;

a plurality of crackers, each of said crackers being coupled to one of said connecting members and positioned generally between a pair of the gifts.

2. The gift display of claim 1, further comprising a plurality of ornamental members being securably attached to said head member, said plurality of ornamental members comprising:

a pair of eyes;

a nose member; and a mouth.

3. The gift display of claim 2, further comprising a scarf having a pair of ends releasably tied together, a hat being securably attached to a top portion of said head member.

4. The gift display of claim 1, further comprising a plurality of name tags, each of said name tags being attached to at least one of an end of each of said tying members.

5. The gift display of claim 1, each of said crackers comprising:

a pair of pull strips having a first end and a second end, said first ends of each of said pull strips being movably coupled together such that said first end of each of said pull strips overlap each other;

a casing for covering said first ends each of said pull strips;

an explosive powder being positioned between an inner surface of said overlapping pull strips;

an ignition means for igniting said explosive powder being attached to each of said pull strips and positioned generally adjacent to said first end of each of said strips; and wherein said second ends of each of said pull strips of one of said cracker are pulled away from each other by pulling said gifts apart causing said ignition means on said pull strips to selectively engage causing a spark to ignite said explosive powder tearing said casing and creating a cracking noise.

6. The gift display of claim 5, wherein said casing comprises a panel extending around said first end of each of said pull straps.

7. The gift display of claim 1, further comprising a frame for supporting said cover member, said frame comprising a base and at least a pair of arched members.

8. The gift display of claim 7, wherein said base has a top surface, a bottom surface and a peripheral edge, each of said arched members has a pair of ends, each of said ends being removably insertable in a hole in said base, each of the gifts being removably stored between each of said arched members and selectively rest on said top surface of said base.

9. A gift displaying system resembling a figurine for displaying a plurality of gifts tied together, said system comprising:

a frame, said frame comprising:

a base;

a plurality of arched members, each of said arched members having a pair of ends, each of said ends being removably insertable in a hole in said base;

wherein the gifts are removably stored between each of said arched members;

a cover resembling a snowman for concealing any gifts resting on said base of said frame, said cover member comprising:

a head member;

a body member comprising a panel being attached to and extending downwardly from a lower portion of said head member such that said panel defines a cavity extending from a free edge of said panel toward said head member;

a means for connecting the gifts together, said means for connecting the gifts together comprising a plurality of connecting members; and a plurality of crackers, each of said crackers being coupled to one of said connecting members and positioned generally between a pair of the gifts.

10. The gift display of claim 9, further comprising a plurality of ornamental members being securably attached to said head member, said plurality of ornamental members comprising:

a pair of eye members;

a nose member;

a mouth member;

a scarf; and a hat.

11. The gift display of claim 9, further comprising a plurality of name tags, each of said name tags being attached to an end of one connecting members.

12. The gift display of claim 9, wherein each of said crackers comprises:

a pair of pull strips having a first end and a second end, said first ends of each of said pull strips being movably coupled together such that said first end of each of said pull strips overlap each other;

a casing for covering said first ends each of said pull strips;

an explosive powder being positioned between an inner surface of said overlapping pull strips; and an ignition means for igniting said explosive powder.

13. The gift display of claim 12, wherein said casing comprises a panel extending around said first end of each of said pull straps.

14. The gift display of claim 12, wherein said second ends of each of said pull strips of a said cracker are pulled away from each other by pulling said gifts apart causing said ignition means on said pull strips to selectively engage causing a spark to ignite said explosive powder tearing said casing and creating a cracking noise.

15. A gift displaying system resembling a snowman for displaying a plurality of gifts tied together, said system comprising:

a frame, said frame comprising:

a base having a top surface, a bottom surface and a peripheral edge, said top surface having a plurality of holes extending therein, each of said holes being positioned generally adjacent to said peripheral edge, each of said holes being spaced apart around said peripheral edge of said base, said base comprising a substantially rigid material;

a plurality of arched members, each of said arched members having a pair of ends, each of said ends being removably insertable in one of said holes in said base, said holes being positioned in a manner such that a plane defined by a first arched member is orientated generally perpendicular to a plane defined by a second arched member, each of said arched members comprising a generally rigid material;

wherein the gifts are removably stored between each of said arched members and selectively rest on said top surface of said base;

a cover resembling a snowman for concealing any gifts resting on said base of said frame, said cover member comprising:

a head member, said head member comprising a generally cotton material having a generally spheroidal-shape;

a body member comprising a panel being attached to and extending downwardly from a lower portion of said head member such that said panel defines a cavity extending from a free edge of said panel toward said head member, said body member comprising a generally cotton material;

wherein each of said arched members are removably insertable into said cavity of said body member;

a plurality of ornamental members being securably attached to said head member, said plurality of ornamental members comprising:

a pair of eye members being attached to a front portion of said head member, each of said eye members comprising a pair of generally circular disks, each of disks comprising a substantially rigid material;

a nose member being attached to said front portion of said head member and positioned generally adjacent to said eye members, said nose member comprising a generally circular disk, said disk comprising a substantially rigid material;

a mouth member being attached to said front portion of said head member and positioned generally adjacent to said nose member, said mouth member comprising a panel, said panel comprising a generally cloth material;

a scarf having a pair of ends releasably tied together, said scarf being positioned generally between said head member and said body member, said scarf member comprising a cloth material;

a hat being securably attached to a top portion of said head member, said hat comprising a top hat having a crown coupled to a brim, said brim being attached to said head member, said hat comprising a generally rigid material;

a means for connecting the gifts together, said means for connecting the gifts together comprising:

a plurality of connecting members, each of said connecting members having a pair of ends, each of said connecting members being releasably tied around two of the gifts such that a length of said connecting member extends between the two gifts, one of said ends of each of said connecting members extending away from each of the tied gifts, each of said connecting members comprising a string;

a plurality of crackers, each of said crackers being coupled to one of said connecting members and positioned generally between a pair of the gifts, each of said crackers comprising:

a pair of pull strips having a first end and a second end, said first ends of each of said pull strips being movably coupled together such that said first end of each of said pull strips overlap each other, each of said pull strips comprising a resiliently flexible material;

a casing for covering said first ends each of said pull strips, said casing comprising a panel extending around said first end of each of said pull straps, said casing comprising a generally paper material;

an explosive powder being positioned between an inner surface of said overlapping pull strips, said explosive powder comprising a substantially ignitable material;

an ignition means for igniting said explosive powder, said ignition means being attached to each of said pull strips and positioned generally adjacent to said first end of each of said strips, said ignition means comprising a flint; and wherein said second ends of each of said pull strips of a said cracker are pulled away from each other by pulling said gifts apart causing said ignition means on said pull strips to selectively engage causing a spark to ignite said explosive powder tearing said casing and creating a cracking noise; and a plurality of name tags, each of said name tags being attached to one of said ends of each of said tying members, each of said name tags being positioned generally adjacent to one of the gifts and extending underneath said free edge of said body member, each of the name tags comprising a piece of substrate having a mark thereon.

* * * * *